United States Patent [19]

Hanson et al.

[11] Patent Number: 4,524,967

[45] Date of Patent: Jun. 25, 1985

[54] ACTION MATCHING GAME

[75] Inventors: Steven P. Hanson, Winnetka; Jeffrey D. Breslow, Highland Park, both of Ill.

[73] Assignee: Marvin Glass & Associates, Chicago, Ill.

[21] Appl. No.: 578,053

[22] Filed: Feb. 9, 1984

[51] Int. Cl.[3] ..... A63F 9/00

[52] U.S. Cl. ..... 273/1 GE; 273/273

[58] Field of Search ..... 273/1 G, 1 R, 1 M, 1 GE, 273/1 GD, 1 GF, 1 GG, 273

[56] References Cited

U.S. PATENT DOCUMENTS

| | | | |
|---|---|---|---|
| 3,471,149 | 10/1969 | Glass | 273/1 GF |
| 4,214,750 | 7/1980 | Shimizu | 273/1 GD |
| 4,309,035 | 1/1982 | Goldfarb | 273/273 X |
| 4,310,156 | 1/1982 | Kulesza | 273/1 GE |
| 4,326,709 | 4/1982 | Croyle | 273/1 GG X |

*Primary Examiner*—Harland S. Skogquist
*Attorney, Agent, or Firm*—John S. Pacocha

[57] ABSTRACT

A game for picking and identifying figurines during a timed turn for matching with corresponding identification on a card. The game housing establishes a raised playing surface having a number of openings communicating with the interior of the housing. Under the playing surface there is a spring motor driven cam with three identical lobes and having an outwardly extending lever for winding the motor for a single cycle of approximately 125 degrees of rotation. Above the cam there is a follower riser having two concentric coplanar annular plates that support the figurines for simultaneous, essentially vertical, raising and lowering of the figurines through the openings. Keeper rings on the follower riser cooperate with guide posts in the housing to maintain the essentially vertical movement.

16 Claims, 7 Drawing Figures

ACTION MATCHING GAME

BACKGROUND OF THE INVENTION

1. FIELD OF THE INVENTION

This invention relates generally to action games and more particularly to games in which pieces are periodically exposed for picking.

2. BACKGROUND ART

Action games, including those in which pieces are selectively exposed for short periods of time during which the player is to pick the piece, have provided both children and adults with enjoyable, competitive recreation. An example of such a game is shown in U.S. Pat. No. 4,310,156 in which pegs are selectively raised relative to a playing surface by cams rotting below the playing surface by a windup spring motor. U.S. Pat. No. 4,214,750 also discloses a game in which magnetic pieces are selectively exposed above the playing surface by rotating cams for catching with a magnet. In such prior art games the player's hand to eye coordination and manual dexterity in picking the selectively exposed piece are tested. Another form of game which has provided considerable entertainment is a recollection matching game in which the player attempts to uncover a match to an identified reference. Such games have been embodied in various forms and have involved the matching of audio indicia as well as visual indicia. A game combining the desirable features of both the matching type games and the piece picking games would be desirable. However, for such combined play, the pieces from which the match is to be selected should be simultaneously, rather than selectively, exposed for picking.

SUMMARY OF THE INVENTION

The present invention is concerned with providing a game for a number of players in which a plurality of pieces are simultaneously exposed for picking to identify the individual pieces and attempting to match one of the pieces with an identified reference. These and other objects and advantages of the invention are achieved by providing a housing establishing an upwardly facing playing surface and containing a motor driven cam with a cam follower riser providing a supporting surface maintained generally parallel to the playing surface. A number of openings receiving similar appearing pieces extend through the playing surface such that the pieces are supported on the cam follower surface. The cam follower is movable substantially perpendicular to the playing surface between a position in which the pieces are all disposed below the surface and one in which they are all exposed above the surface for picking by the players. At all times, except when picked up by a player, the identity of each piece is obscured. Cards having matching identifications are also supplied.

BRIEF DESCRIPTION OF THE DRAWINGS

For a better understanding of the present invention reference may be had to the accompanying drawings in which:

FIG. 6 is a sectional view, similar to that of FIG. 5 but in the raised position.

DETAILED DESCRIPTION OF THE PREFERRED EMBODIMENT

Figure 1:
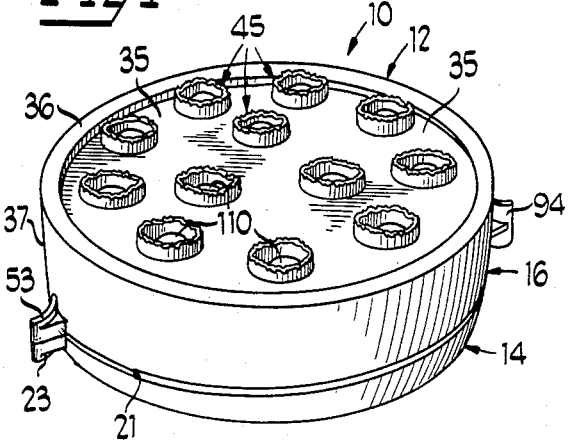
FIG. 1 is a perspective view of an embodiment of the present invention in the lowered position with the pieces below the playing surface.
Figure 2:
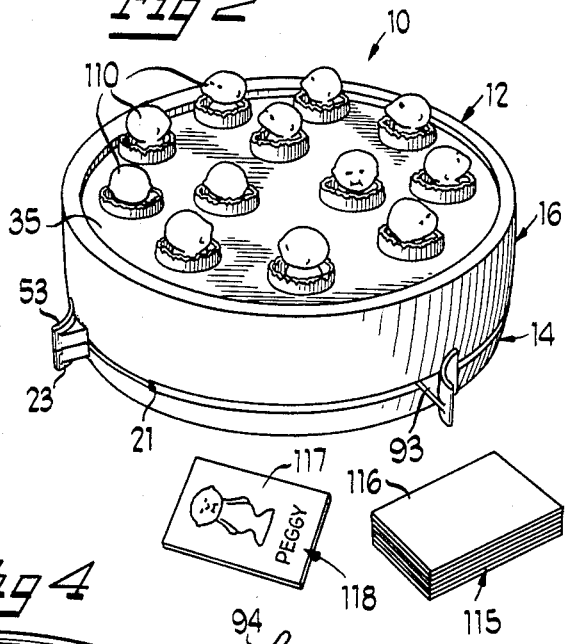
FIG. 2 is a perspective view of the same embodiment in the raised position with the pieces exposed above the playing surface for picking as well as showing cards usable with the present invention.
Figure 3:
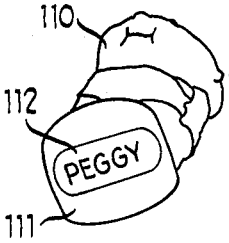
FIG. 3 is an enlarged scale, perspective view of a piece usable with the present invention.
Figure 4:
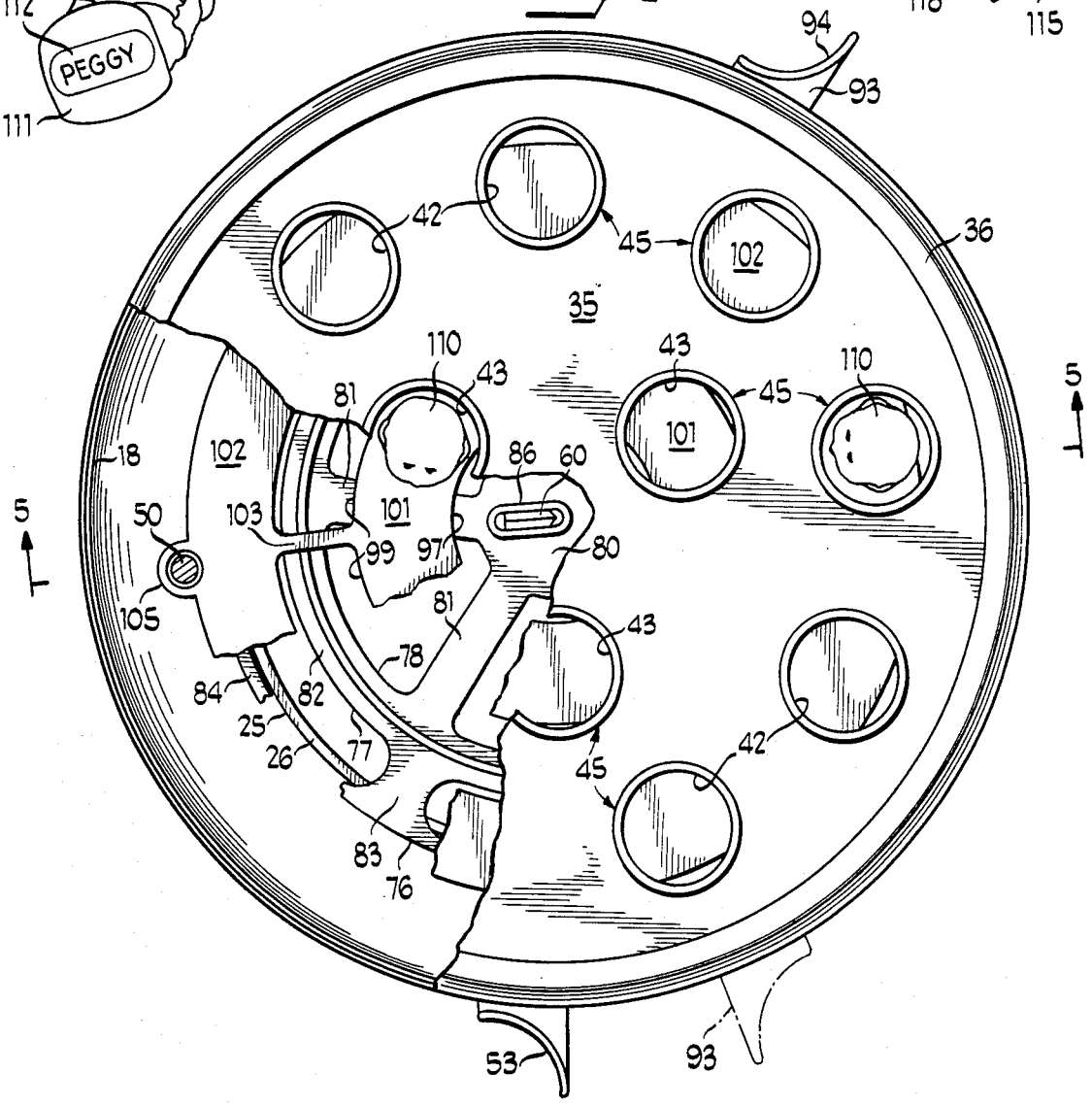
FIG. 4 is an enlarged scale, partially broken-away, top plan view.

Referring now to the drawings in which like parts are designated by like reference characters throughout the several views, there is shown a game 10 including a housing 12. Conveniently, housing 12 is formed of a lower base 14 and an upper cover 16.

Base 14 is generally bowl shaped with a substantially flat bottom 17 for support on a table or the like. Short downwardly projecting rubber feet (not shown) could be provided for additional stability if desired. An upwardly projecting inner circumferential lip 18 is formed throughout approximately 230 degrees of the upper edge of the base 14. The entire edge of the remaining 130 degrees is stepped down a short distance forming vertical end walls 20 and 21. Accordingly, a generally horizontally disposed flat edge 22 is formed that is lower than the top edge of lip 18. Attached to or integrally molded on the portion of the outside wall of the housing having the upwardly extending inner lip approximately 20 degrees away from the end wall 21, is the lower half of a stationary holding tab 23.

Within the base 17, there is a substantially concentric, upwardly extending, inner circular wall 25 that may be integrally formed. The inner wall has a top edge 26 that is substantially parallel to the bottom 17 and spaced from the bottom 17 approximately the same height as the edge 22. Also integrally formed with and projecting upwardly from the base 14 are motor mounting bosses 28 and 29 plus three lower posts 30, 31 and 32 that are spaced apart around the outside of the inner wall 25.

Cover 16 is generally shaped like an inverted bowl and has a top generally flat surface 35 disposed within an upwardly extending annular outside rim 36. An outside, downwardly depending circumferential wall 37 has a bottom edge with an inner circumferential recess 38 extending throughout about 230 degrees of the circumference. The recess 38 mates with the upwardly projecting lip 18 on the base 14. Although the recess 38 is not required throughout the remaining 130 degrees of the circumference, it may be included for convenience of manufacture. Throughout the 130 degrees overlying the lower edge 22, the bottom edge 40 of the wall 37 forms the top of an approximately 130-degree slot positioned roughly midway up the side of the housing 12.

Extending through the flat top 35 are nine outer openings 42 and three inner openings 43. Each of the openings 42 and 43 has a vertical tubular wall 45 with a lower portion 46 that depends down below the top 35 and an upper portion 47 that projects above the top 35 and also somewhat above the top of the annular rim 36. The top edge of the portion 47 is serrated in an irregular manner for purposes of ornamentation compatible with the theme of the preferred embodiment. Tubular walls 45 may all be integrally formed with the upper housing cover 16.

Also integrally formed with the cover 16 is a downwardly depending upper guide post 50 plus two other similar upper guide posts (not shown). The upper guide post 50 is seated upon the lower guide post 30 and the other two guide posts that are not shown are so positioned on the inside of the cover 16 as to mate with the lower guide posts 31 and 32. Also attached to, or integrally formed with, the cover 16 adjacent the bottom edge of the depending side wall 37 is an upper stationary tab 53 that mates with the lower tab 23 on the base 14.

Mounted within the housing base on the bosses 28 and 29 is a spring wound governed motor 55. The motor includes a frame 56 secured to the bosses 28 and 29 by means of screws, heat staking or the like. Within the frame is a coil spring 58 having one end 59 secured to the frame 56. Spring 58 is coiled about and secured at the other end for rotation with "L" shaped drive shaft 60. Also secured for rotation to shaft 60 is drive gear 61 which engages idler gear sets 63 and 64 to drive a pinion 66 mounted for rotation on shaft 67 together with star escapement wheel 68. Gear set 64 is mounted in slots (not shown) in the frame 56 for sliding movement so that during winding of the spring 58 the gear set 64 is driven by the gear set 63 out of engagement with pinion 66. However, during the unwinding of the spring, the reverse rotation of the gear sets slides gear set 64 into engagement with the pinion 66 to rotate the star wheel 68. Rotation of the star wheel 68 during unwinding of the spring is limited by engagement with the pivotally mounted oscillating governor leaf 70 to regulate the speed of rotation of the shaft 60.

Positioned on top the motor 55 is a cam drive 75 which includes a skeletal disk 76. Although a solid disk could be used, the outer openings 77 plus the inner openings 78 reduce the overall weight of the cam drive 75, making it easier to drive as well as saving material costs. Thus, the skeletal disk 76 has an inner hub 80 from which a number of radially extending spokes 81 join the middle concentric member 82. Similarly, three radially extending webs 83 from member 82 join the outer flange 84. Extending from the top of the hub 80 is an oblong sleeve 86 which fits, in driving engagement, over the "L" shaped motor output shaft 60. Drive sleeve 86 is offset from the center to accommodate the short leg of the "L" shaped drive shaft. The top edge 26 of the inner circular wall 25 bears the cam disk 76 for rotation with the underside of each of the three radial webs 83 contacting the top edge. To further minimize the contact surface, and thereby minimize the friction during rotation, relatively thin downwardly projecting radial ribs may be formed on the underside of each of the webs 83. Projecting upwardly from the inner concentric member 82 are three cam lobes 88. Each of the cam lobes is identical and radially spaced the same distance from the center of the hub 80. The peak 89 of each cam lobe is identical as are the ascending and descending angled surfaces 90 and 91, respectively. An ascending and descending surface of adjoining lobes meet at a low point 92.

Lever arm 93 is formed as an extension of the drive disk 76 projecting out beyond the outer flange 84. On the free end of the lever 93 a transverse, curved finger tab 94 is formed. When the drive cam 75 is seated upon the inner circular wall 25 in driving engagement with the motor shaft 60, the lever arm 93 projects out of the housing through the approximately 130-degree slot formed between the base 14 and the cover 16. The generally vertical end walls 20 and 21 of the slot limit the angular rotation of the lever 93 and hence the entire cam drive to approximately 125 degrees. Approximately 5 degrees of the slot are taken up by the width of the lever 93 and the additional 5 degrees of freedom in the slot provide some tolerance and also accommodate the shifting of the gear set 64 when the lever is pulled back toward the holding tabs 23 and 53.

Figure 7:
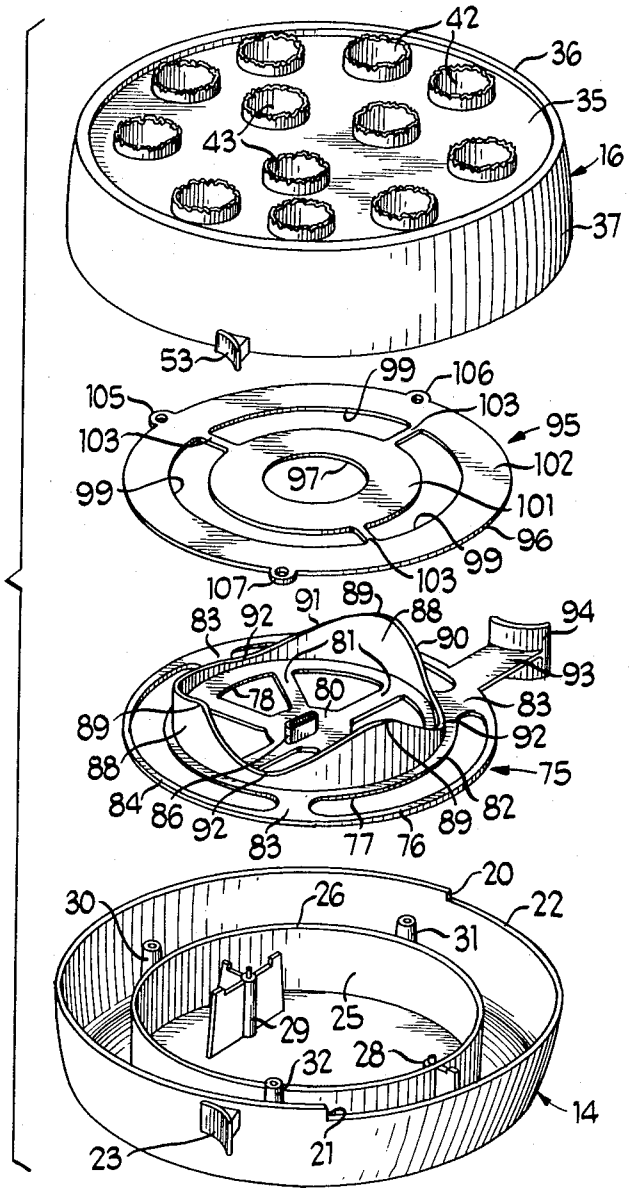
FIG. 7 is an exploded perspective view.

Above the cam drive 75 is a cam follower riser 95 which also includes a plate 96 with a number of openings. However, the plate 96 openings, in addition to reducing the weight of the plate to facilitate movability and reduce costs, are necessary to the functioning of the follower plate. In the center there is a relatively large bore 97. Three equal arcuate openings 99, spaced at equal intervals, divide the plate 96 into an inner annular plate 101 and an outer coplanar annular plate 102. Between the two annular plates there are three radially extending arms 103. Spaced about the periphery of the outer annular plate 102 are three keeper rings 105, 106 and 107. Each of the keeper rings are identical and designed to fit over a respective one of the upper guide posts for free reciprocal vertical movement of the cam follower. As will be noted in FIG. 7, the keeper rings and guide posts are not at equally spaced 120-degree intervals because it is necessary to space the posts 31 and 32 apart more than 130 degrees to permit the approximately 125-degree rotation of the lever arm 93.

Radial arms 103 ride upon the edges or angled surface of the cam lobes. The follower riser 95 is angularly oriented with respect to the cam drive 75 such that in the at rest, or non-driven, position each of the three radial arms 103 are at the bottom or low point 92 of adjoining cam lobes. Thus, when the lever arm 93 is pulled back from adjacent the wall 20 in the slot to the end wall 21, winding the motor 55, the follower riser 95 will, rather quickly, move through a single up and down again cycle with the radial arms 103 then resting in the next adjoining low point 92.

Maintaining the cam in the pulled back or cocked position with one hand is facilitated by the holding tab formed by the parts 23 and 53, as for example by resting the thumb on the stationary tab and keeping the index or perhaps the index and middle finger of the same hand on the curved tab portion 94 of the lever 93. Once the lever 93 is released, the governed motor 55 will rotate the cam drive 75 through a single cycle of approximately 125 degrees of rotation in about four to five seconds from a first lowered position to a raised position and then back down again to a lowered position.

Supplied as part of the game 10 are twelve pieces 110 each in the form of a figurine resembling one of the "CABBAGE PATCH KIDS" dolls manufactured by Coleco Industries, Inc. under license from Original Appalachian Artworks Inc. All of the pieces 110 have a generally flat bottom surface 111 and are similar in appearance. Each of the figurines is distinguished from every other figurine by attachment of a name label 112 to the bottom surface 111. Pieces 110 may be of any desired configuration and have a number of changes in width as long as there is no portion having a diameter that is about an eighth inch smaller than the inside diameter of the tubes 45. The height of the pieces should be greater than the distance between the top surface of the annular plates 101 and 102 and the bottom of the tube 45 but not greater than the distance from the top surface of the plates 101 and 102 and the top edge of the tube 45.

Figure 5:
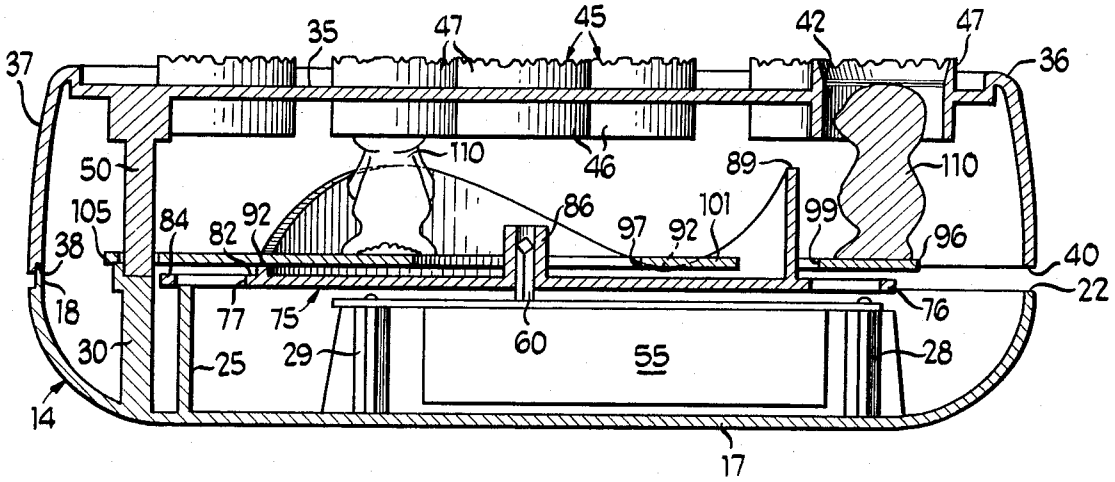
FIG. 5 is a sectional view taken generally along the line 5—5 of FIG. 4.
Figure 8:
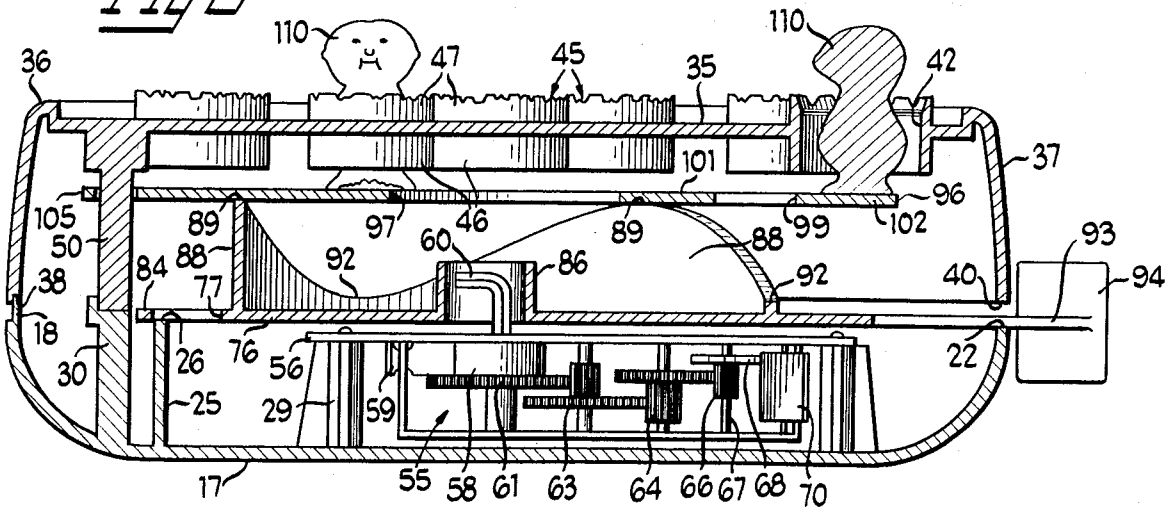

Thus, when the cam follower is in the lowered position as illustrated in FIG. 5, the pieces 110 will be disposed below the top of the tubes 45 and hence may not be picked up or grasped. However, when the follower 95 rises to the peaks of the cam lobes the pieces 110 are exposed above the playing surface and may be readily picked by the players. Cam follower riser 95 moves substantially vertically while maintaining a general parallel relationship to the playing surface which the tops of the tubes 45 extending above the top 35 generally define. The three cam lobes together with the cooperating keep rings and guide posts provide sufficiently smooth, essentially vertical movement of the riser. In addition to providing for simultaneous exposure and then retraction of each of the pieces facilitating the play of a pick and match game, it is also important to maintain the follower substantially perpendicular to the playing surface during the reciprocating movement because of the irregular contours of the figurines 110.

It would be possible to play a game using the invention described thus far by having pairs of identically identified pieces so that once the player identifies a particularly named figurine the player must then locate the matching one of the pair. However, in keeping with the theme of the "CABBAGE PATCH KIDS", no two of the pieces or figurines 110 are identical. Hence, in order to provide for matching, a second set of pieces in the form of cards, or adoption papers, 115 are provided. Each card has a similarly decorated or blank back side 116 and a face 117 picturing the figurine and bearing an identifying name 118. In play, a card is turned over identifying a particular piece and each player is given a turn during which the cam drive 75 is activated and released, which first raises the pieces 110 to permit them to be picked up and then lowers the piece back below the playing surface precluding further picking. During this automatically timed turn, the player is to pick as many pieces as the player is able and turn each over to identify the pieces in order to match the card. Once a match is made during the turn, the player is permitted to take the next card on the top of the stack, turn it over and try to pick the matching figurine. Of course, as play progresses players are to try and recall where previously identified pieces are so that once the card is turned over they may immediately pick the matching piece. The player keeps each matched figurine, and the player having the most when all have been picked wins the game.

While a particular embodiment of the present invention has been shown and described, other changes and modifications will occur to those skilled in the art. It is intended in the following claims to cover all such changes and modifications as fall within the true spirit and scope of the present invention.

What is claimed as new and desired to be secured by Letters Patent is:

1. A game comprising:

a housing with means establishing an upwardly disposed playing surface;

motor means mounted within the housing;

cam means driven by the motor means;

a cam follower disposed between the cam means and the playing surface;

the cam follower having an upwardly disposed supporting surface essentially parallel to the playing surface;

means mounting the cam follower within the housing for movement of the supporting surface substantially perpendicular to the playing surface;

a plurality of openings extending through the playing surface;

a first set of pieces, each piece having a bottom surface, insertable into the openings and seatable upon the cam follower supporting surface;

the cam means moving the cam follower between a first position in which all of the pieces of the first set are substantially disposed below the playing surface and a second position in which the pieces of the first set are generally exposed above the playing surface permitting each piece of the first set to be picked up by a player;

identifying means on the bottom surface of each piece of the first set distinguishing each piece from every other piece; and the identifying means being obscured while the pieces of the first set are seated on the cam follower supporting surface.

2. The game of claim 1 including a second set of pieces each bearing identifying means matching with the identifying means on each of the first set of pieces.

3. The game of claim 1 in which the first set of pieces are figurines.

4. The game of claim 3 in which the identifying means are labels bearing names.

5. The game of claim 1 including a tube surrounding each opening and depending downwardly from the playing surface to a plane spaced above the cam follower supporting surface in both the first and second positions.

6. The game of claim 1 in which the motor means is a spring wound motor and a lever for winding the motor extends out of the housing below the playing surface.

7. The game of claim 6 in which the lever is integral with the cam means.

8. The game of claim 6 in which:

the housing has a side wall depending below the playing surface;

a slot with closed ends extends through the side wall;

the lever extends through the slot; and the ends of the slot limit movement of the lever to wind the motor for a single cycle of the cam means.

9. The game of claim 1 in which the cam means is a disk with a plurality of spaced lobes.

10. The game of claim 9 including an upwardly extending circular wall outlining the housing having a top edge bearing the cam disk for rotation.

11. The game of claim 10 including a plurality of radial ribs on the underside of the cam disk contacting the top edge of the inner circular wall and spacing the cam disk from the top edge.

12. The game of claim 9 in which the lobes are all of the same height and have substantially identically angled surfaces.

13. The game of claim 9 in which the lobes are all radially spaced the same distance from the center of the disk.

14. The game of claim 9 in which there are three cam lobes.

15. The game of claim 9 in which:

the cam follower has an inner annular plate and an outer annular plate;

both the inner ring and the outer annular plates have coplanar upwardly facing surfaces;

radial arms extend between the inner and outer annular plates; and each radial arm follows a lobe on the cam.

16. The game of claim 1 including:

guide posts mounted within the housings;

the guide posts being substantially perpendicular to the playing surface; and keeper rings on the cam follower engaging each of the guide posts to restrict movement of the cam follower generally perpendicular to the playing surface.

* * * * *